US012480322B1

(12) United States Patent
Li

(10) Patent No.: US 12,480,322 B1
(45) Date of Patent: Nov. 25, 2025

(54) FOLDABLE POOL

(71) Applicant: Shenzhen Lulakesi Technology Co., Ltd., Shenzhen (CN)

(72) Inventor: Xianjiang Li, Rugao (CN)

( * ) Notice: Subject to any disclaimer, the term of this patent is extended or adjusted under 35 U.S.C. 154(b) by 0 days.

(21) Appl. No.: 18/760,985

(22) Filed: Jul. 1, 2024

(30) Foreign Application Priority Data

May 22, 2024 (CN) ..... 202421124352.3

(51) Int. Cl.
*E04H 4/00* (2006.01)

(52) U.S. Cl.
CPC ..... *E04H 4/005* (2013.01)

(58) Field of Classification Search
CPC ..... E04H 4/0018; E04H 4/0043; E04H 4/005; A47K 3/06; A47K 3/062; A47K 3/064; A47K 3/07; A47K 3/074; B65D 90/02; B65D 90/023; B65D 90/021
See application file for complete search history.

(56) References Cited

U.S. PATENT DOCUMENTS 5,762,233 A * 6/1998 Van Romer ..... B64F 5/30 220/9.1
8,955,703 B2 * 2/2015 McAtarian ..... F16N 31/002 220/666
9,586,715 B2 * 3/2017 Beak ..... B65D 90/24
2003/0029873 A1 * 2/2003 Moffat ..... F16N 31/006 220/573

FOREIGN PATENT DOCUMENTS

DE 202020107182 U1 * 3/2021

* cited by examiner

*Primary Examiner* — Janie M Loeppke

(57) ABSTRACT

A foldable pool includes a foldable pool body and a pool bottom made of a flexible material. A plurality of supporting structures are arranged on an outer side wall of the pool body. Each supporting structure includes a limiting pull strap, an inclined pull strap, and a first hard panel. One end of the limiting pull strap is connected to one end of the inclined pull strap. The limiting pull strap and the inclined pull strap are both made of flexible materials. The other end of the limiting pull strap is connected to the pool bottom or a position of the pool body close to the pool bottom. The other end of the inclined pull strap is located above the limiting pull strap and connected to the pool body. The first hard panel is detachably arranged on the inclined pull strap.

19 Claims, 4 Drawing Sheets

FOLDABLE POOL

CROSS-REFERENCE TO RELATED APPLICATIONS

The application claims priority of Chinese patent application NO.2024211243523, filed on May 22, 2024, which is incorporated herein by reference in its entireties.

TECHNICAL FIELD

The present disclosure relates to the technical field of pools, and in particular, to a foldable pool.

BACKGROUND

A pet pool is a product used for allowing a pet to take a bath and swim. To facilitate storage and transportation, foldable pet pools have emerged on the market. The pool is generally composed of an annular pool body and a pool bottom, and the pool body is generally composed of two layers of fabrics and a hard panel located between the two layers of fabrics. The pool bottom is made up of a layer of fabric that is the same as that of the pool body. To improve the stability of the pool during use, an inclined supporting structure is arranged on a side wall of the pool body. The inclined supporting structure includes a limiting bottom fabric connected to the pool bottom and a supporting plate, and a layer of fabric is wrapped outside the supporting plate. The supporting plate is arranged inside the fabric and cannot be disassembled. Therefore, when the pool body is folded and stored, the supporting plate will protrude out of the pool body, which increases the volume for storage and product packaging and increases the transportation cost.

SUMMARY

The present disclosure mainly aims to provide a foldable pool used to solve the problem that when the existing foldable pool is stored, a supporting plate protrudes out to increase the volume.

In order to solve the technical problem, the technical scheme provided by the present disclosure is as follows.

A foldable pool includes a foldable pool body and a pool bottom made of a flexible material, wherein a plurality of supporting structures are arranged on an outer side wall of the pool body; each supporting structure includes a limiting pull strap, an inclined pull strap, and a first hard panel;

one end of the limiting pull strap is connected to one end of the inclined pull strap; the limiting pull strap and the inclined pull strap are both made of flexible materials; the other end of the limiting pull strap is connected to the pool bottom or a position of the pool body close to the pool bottom; the other end of the inclined pull strap is located above the limiting pull strap and connected to the pool body; and the first hard panel is detachably arranged on the inclined pull strap.

Further, a first mounting chamber with a first opening on one side is formed on the inclined pull strap; and when the first hard panel is assembled on the inclined pull strap, the first hard panel is arranged in the first mounting chamber.

Further, the inclined pull strap includes an outer inclined layer and an inner inclined layer, and the first mounting chamber is formed by connecting the outer inclined layer to the inner inclined layer.

Further, the limiting pull strap and the inner inclined layer use the same piece of laminated fabric.

Further, a top of the outer inclined layer is fixed on the pool body, and a bottom of the outer inclined layer is fixed at a bottom of a side surface of the inner inclined layer away from the pool body; and a top end of the inner inclined layer is connected at a position of the outer inclined layer close to the top.

Further, both the outer inclined layer and the inner inclined layer are square; a top edge, a bottom edge, and a side edge of the inner inclined layer are all welded to the outer inclined layer to form a first indentation; a top edge of the outer inclined layer is welded to the pool body to form a second indentation; and the second indentation is located above the first indentation.

Further, a width of the first indentation is 3 mm to 15 mm.

Further, the pool body is annular and includes a flexible inner layer, a flexible outer layer, and a plurality of second hard panels; the flexible inner layer is connected to the flexible outer layer to form a plurality of second mounting chambers which are horizontally spaced and distributed; a crease portion is formed between two adjacent second mounting chambers; and the second hard panels are arranged in the second mounting chambers.

Further, a top of the flexible inner layer is welded to a top of the flexible outer layer; a bottom of the flexible outer layer is welded to the bottom and top of the flexible inner layer; two sides of the flexible inner layer are overlapped and welded to two sides of the flexible outer layer; the flexible outer layer is welded to the flexible inner layer on two sides of the second mounting chambers to form crease portions; and each second mounting chamber is surrounded by a third indentation, a fourth indentation, and two adjacent crease portions.

Further, a width of each crease portion is 3 mm to 15 mm.

Further, a cross section of the pool body is octagon; three second hard panels are arranged on a pair of opposite side walls of the pool body; one second hard panel is arranged on each of the other four side walls of the pool body.

the number of the supporting structures is eight; one supporting structure is provided at a position, corresponding to each second hard panel, on the side wall of the pool body that is correspondingly provided with the three second hard panels; and the other two second hard panels correspond to the other pair of opposite side walls of the pool body.

Further, a top of the pool body is connected with a top covered edge; one end of the top covered edge is connected to the flexible inner layer; and the other end of the top covered edge is connected to the flexible outer layer after being bent.

Further, the top covered edge and the flexible inner layer use the same piece of fabric.

Further, one end of the top covered edge, the top of the flexible outer layer, and the flexible inner layer are welded together to form a third indentation; and a width of the third indentation is 3 mm to 15 mm.

Further, the pool bottom includes a peripheral connecting sheet and a middle sheet; the peripheral connecting sheet is an annular ring; the middle sheet is connected to the peripheral connecting sheet by welding; the middle sheet is located in the middle of the peripheral connecting sheet; and an outer side of the peripheral connecting sheet is connected to a bottom of the pool body.

Further, the middle sheet is welded to the peripheral connecting sheet to form a fourth indentation; and the fourth indentation is located on an inner side of the foldable pool;

a width of the middle sheet and/or peripheral connecting sheet located on the inner side of the foldable pool is greater than or equal to a distance between the pool body and the middle sheet, or a width of the fourth indentation is greater than or equal to the distance between the pool body and the middle sheet.

Further, materials of the flexible outer layer, the flexible inner layer, the top covered edge, the peripheral connecting sheet, the middle sheet, the limiting pull strap, and the inclined pull strap are all laminated fabrics.

Further, a material of the flexible outer layer is a laminated fabric formed by gluing a mesh fabric with yarns heavier than 500D and a density greater than 6*6 pieces/inch, or the flexible outer layer is a fabric with peel strength greater than 25 N/inch;

materials of the top covered edge and the middle sheet are one of the following:

a laminated fabric formed by laminating a polyester or nylon fabric with a polyvinyl chloride (PVC) film;

190T polyester pongee; and a laminated fabric formed by gluing a mesh fabric with yarns heavier than 500D and a density greater than 18*18 pieces/inch.

Further, several first magnetic suction members on the first hard panel; a second magnetic suction member is arranged at a position, corresponding to the first magnetic suction member, on the inclined pull strap; and when the first hard panel is assembled on an outer side or inner side of the inclined pull strap, the first magnetic suction member attracts the second magnetic suction member;

the first magnetic suction member is a magnet or a metal sheet attracted to the magnet, and the second magnetic suction member is a magnet; or, the second magnetic suction member is a metal sheet attracted to the magnet, and the first magnetic suction member is a magnet.

Further, the first hard panel is fixed on an inner side or outer side of the inclined pull strap in a buckled, adhered, welding, or tied manner.

The present disclosure has the beneficial effects: Compared with the prior art, In this invention, by the arrangement of the foldable pool body, the pool bottom made of the flexible material, the limiting pull strap, and the inclined pull strap, the entire pool is foldable. Furthermore, the supporting structures are configured on the outer side wall of the pool body and are configured to achieve an inclined supporting effect during use of the foldable pool, so as to improve the stability of the foldable pool after the foldable pool is filled with water. In addition, the first hard panel is detachably arranged on the inclined pull strap. To store the foldable pool, the first hard panel can be removed from the inclined pull strap to prevent the first hard panel from protruding after the limiting pull strap is folded towards the pool body. This can reduce the size of the foldable pool after storage, reduce a storage space and a transportation space, reduce the costs.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
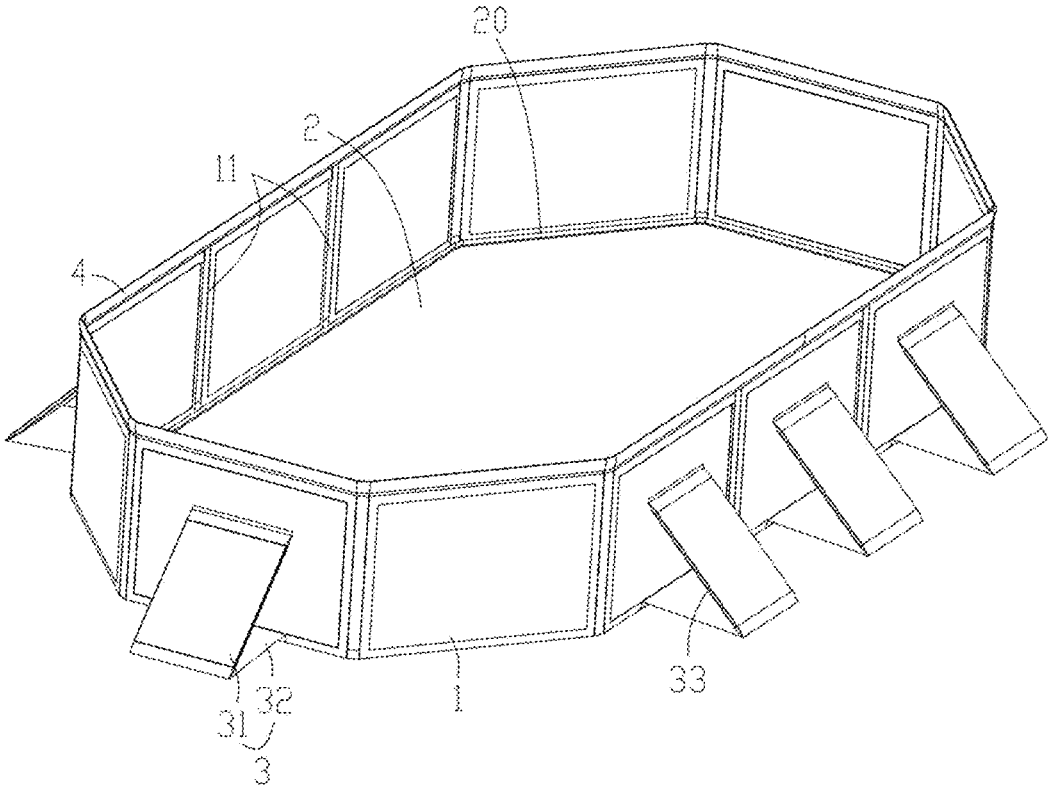
FIG. 1 is a three-dimensional diagram according to the present disclosure.
Figure 2:
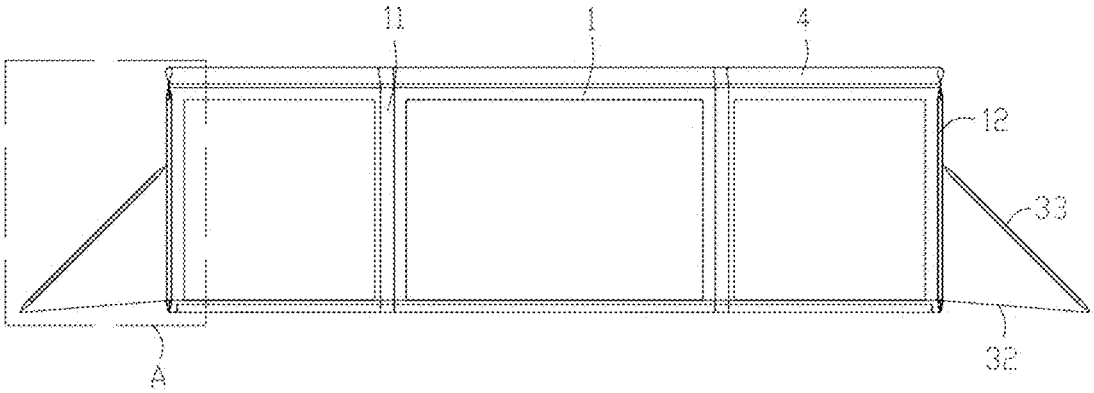
FIG. 2 is a sectional view of a cross section of the present disclosure.
Figure 3:
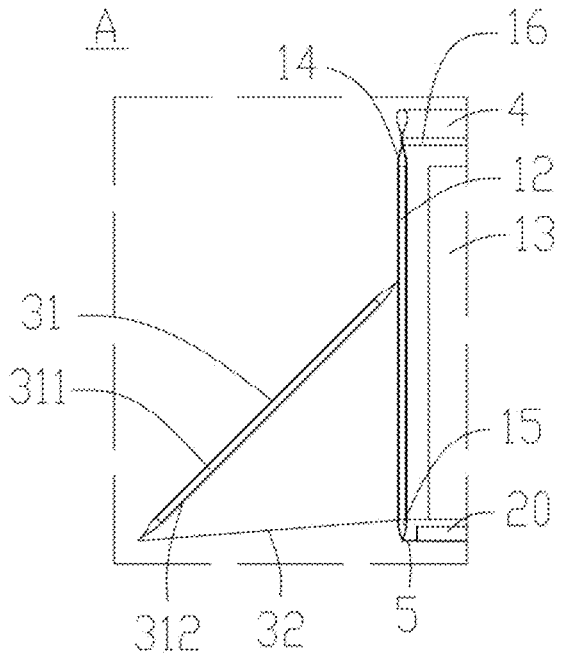
FIG. 3 is an enlarged view of region A in FIG. 3.
Figure 4:
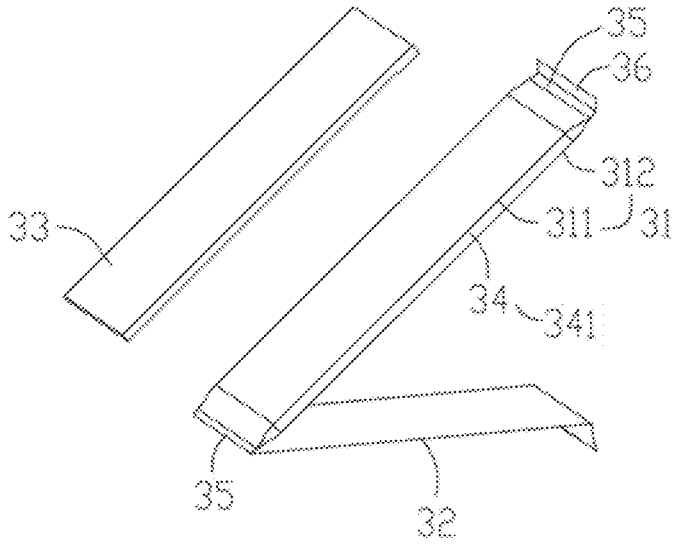
FIG. 4 is an exploded diagram of a supporting structure of the present disclosure.

The accompanying drawings in the embodiment of the present disclosure are combined, The technical scheme in the embodiment of the present disclosure is clearly and completely described, Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

Referring to FIG. 1 to FIG. 4, a foldable pool according to the embodiments of the present disclosure is shown.

The foldable pool includes a foldable pool body 1 and a pool bottom made of a flexible material. A plurality of supporting structures 3 are arranged on an outer side wall of the pool body 1; each supporting structure 3 comprises a limiting pull strap 32, an inclined pull strap 31, and a first hard panel 33. One end of the limiting pull strap 32 is connected to one end of the inclined pull strap 31; the limiting pull strap 32 and the inclined pull strap 31 are both made of flexible materials; the other end of the limiting pull strap 32 is connected to the pool bottom or a position of the pool body 1 close to the pool bottom; the other end of the inclined pull strap 31 is located above the limiting pull strap 32 and connected to the pool body 1; and the first hard panel 33 is detachably arranged on the inclined pull strap 31.

In this embodiment, by the arrangement of the foldable pool body 1, the pool bottom made of the flexible material, the limiting pull strap 32, and the inclined pull strap 31, the entire pool is foldable. Furthermore, the supporting structures 3 are configured on the outer side wall of the pool body 1 and are configured to achieve an inclined supporting effect during use of the foldable pool, so as to improve the stability of the foldable pool after the foldable pool is filled with water. In addition, the first hard panel 33 is detachably arranged on the inclined pull strap 31. To store the foldable pool, the first hard panel 33 can be removed from the inclined pull strap 31 to prevent the first hard panel 33 from protruding after the limiting pull strap 32 is folded towards the pool body 1. This can reduce the size of the foldable pool after storage, reduce a storage space and a transportation space, reduce the transportation costs, and solve the problem that protruding of a supporting plate increases the volume during the storage of the existing foldable pool.

In practical application, the first hard panel 33 can be detachably connected to the inclined pull strap 31 in a push-pull manner.

In an embodiment, a first mounting chamber 34 with a first opening 341 on one side is formed on the inclined pull strap 31. Therefore, to use the foldable pool, the first hard panel 33 can be inserted into the first mounting chamber 34 from the first opening 341, so that the first hard panel 33 is assembled on the inclined pull strap 31, and the first hard panel 33 is used to slantways support the pool body 1. Furthermore, to store the foldable pool, the first hard panel 33 can be withdrawn from the first mounting chamber 34, so that the first hard panel 33 is removed from the inclined pull strap 31.

Specifically, the inclined pull strap 31 includes an outer inclined layer 311 and an inner inclined layer 312. The outer inclined layer 311 is connected to the inner inclined layer 312. The first opening 341 and the first mounting chamber 34 are formed by connecting the outer inclined layer 311 to the inner inclined layer 312. In other embodiments, a plurality of strap bodies are arranged on an inner surface or outer surface of the inclined pull strap 31, and a limiting chamber can be further formed by matching the strap bodies with the inclined pull strap 31 to assemble the first hard panel 33.

To save the manufacturing process, the limiting pull strap 32 and the inner inclined layer 312 use the same piece of laminated fabric, which can save a welding process between two laminated fabrics.

In an embodiment, a top of the outer inclined layer 311 is fixed on the pool body 1, and a bottom of the outer inclined layer 311 is fixed at a bottom of a side surface of the inner inclined layer 312 away from the pool body; and a top end of the inner inclined layer 312 is connected at a position of the outer inclined layer 311 close to the top. In this way, after water is fed into the foldable pool, under the pressure of the water, the supporting structures 3 cause the first hard panel 33 to not directly apply a force to cut off a joint between the outer inclined layer 311 and the pool body 1, but to apply a force to a joint between the top end of the inner inclined layer 312 and the position of the outer inclined layer 311 close to the top end. Furthermore, under the action of the joint between the outer inclined layer 311 and the pool body 1, an abutment force can be further applied to the first hard panel 33 to prevent the top end of the inner inclined layer 312 from being separated from the top of the outer inclined layer 311, thereby improving the stability of mounting and supporting of the supporting structures 3.

Specifically, the outer inclined layer 311 and the inner inclined layer 312 are square; a top edge, a bottom edge, and a side edge of the inner inclined layer 312 are all welded to the outer inclined layer 311 to form a first indentation 35, so as to form the first mounting chamber 34 with the first opening 341 on the side, thus facilitating the mounting of the first hard panel 33. A top edge of the outer inclined layer 311 is welded to the pool body 1 to form a second indentation 36; and the second indentation 36 is located above the first indentation 35.

A width of each of the first indentation 35 and the second indentation 36 can be 3 mm to 15 mm. According to the size of the pool, the widths of the first indentation 35 and the second indentation 36 can be customized to maintain the strength of connection between the outer inclined layer 311 and the inner inclined layer 312, and the strength of connection between the supporting structures 3 and the pool body 1. In this embodiment, the widths of the first indentation 35 and the second indentation 36 are both between 5 mm and 6 mm.

In the above embodiment, when the supporting structures 3 are unfolded to support the pool body 1, an included angle between the limiting pull strap 32 and the inclined pull strap 31 is 30° to 75°. In this way, the first hard panel 33 can effectively support the pool body 1.

In practical application, the first hard panel 33 can alternatively be detachably connected to the inclined pull strap 31 in a magnetic suction manner.

Figure 5:
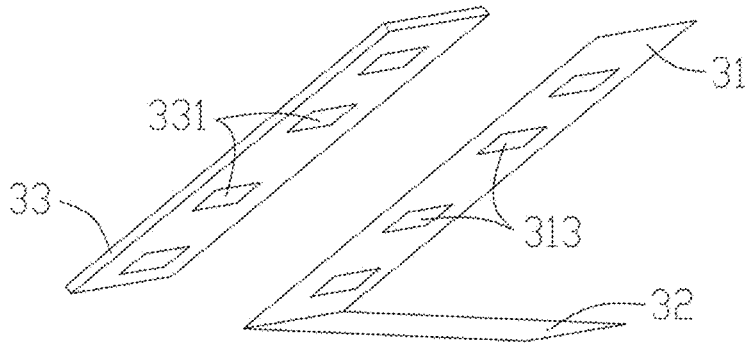
FIG. 5 is a structural diagram of another embodiment of a supporting structure of the present disclosure.

Specifically, one or more first magnetic suction members 331 are arranged on the first hard panel 33, and a second magnetic suction member 313 is arranged at a position, corresponding to the first magnetic suction member 331, on the inclined pull strap 31, as shown in FIG. 5. During use of the foldable pool, the first hard panel 33 can be sucked and fixed on the inclined pull strap 31 through the first magnetic suction members 331 and the second magnetic suction member 313, thus achieving triangular supporting on the pool body 1 in conjunction with the limiting pull strap 32. To make the first hard panel 33 stably support the pool body 1, the first hard panel 33 can be mounted on one side of the inclined pull strap 31 close to the pool body 1. The inclined pull strap 31 and the limiting pull strap 32 are connected to the pool body 1, so that a limiting role can be played in the supporting of the first hard panel 33, which prevents the impact on the supporting effect caused by the fact that the first hard panel 33 moves or even falls off from the inclined pull strap 31 after overcoming a suction force between the first magnetic suction member 331 and the second magnetic suction member 313 during supporting. Of course, in other embodiments, the first hard panel 33 can alternatively be mounted on one side of the inclined pull strap 31 away from the pool body 1.

The first magnetic suction member 331 is a magnet or a metal sheet attracted to the magnet, and the second magnetic suction member 313 is a magnet. Or, the second magnetic suction member 313 is a metal sheet attracted to the magnet, and the first magnetic suction member 331 is a magnet.

Figure 6:
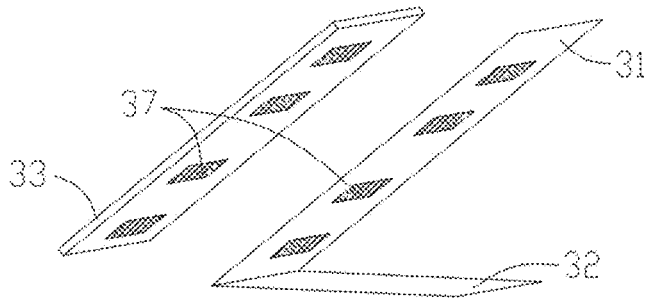
FIG. 6 is a structural diagram of another embodiment of a supporting structure of the present disclosure.
Figure 7:
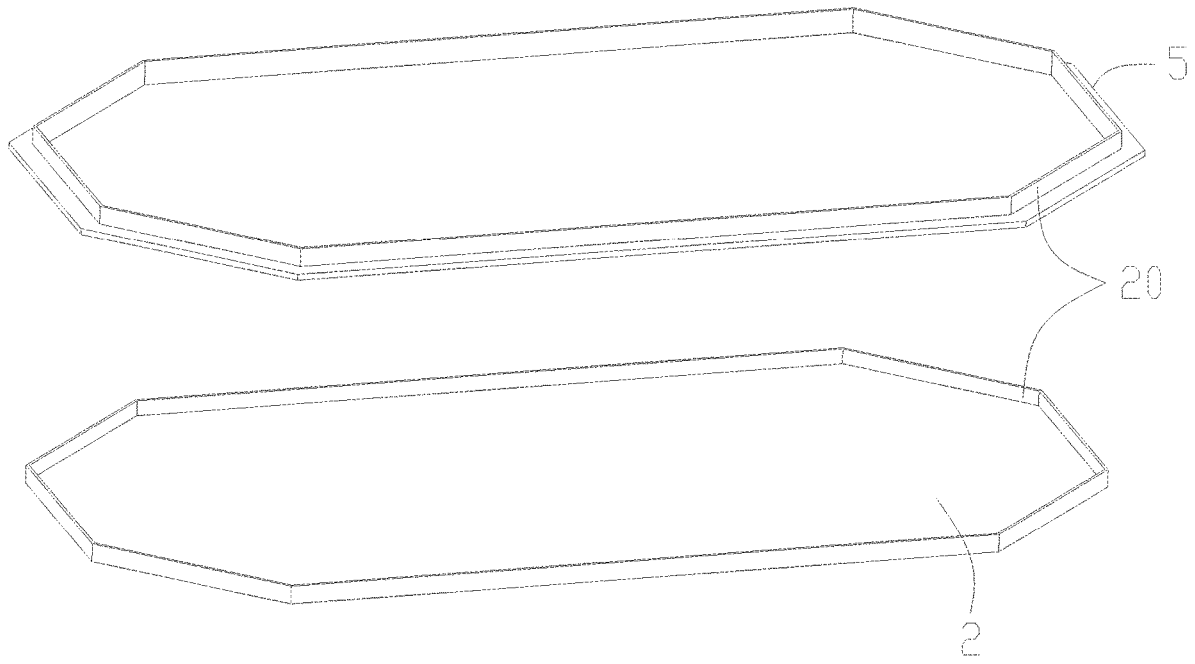
FIG. 7 is an exploded view of the pool bottom.

In practical application, the first hard panel 33 is fixed on an inner side or outer side of the inclined pull strap 31 in a buckled, adhered, or tied manner. The adhesion can be achieved using a hook and loop fastener 37, which means that the first hard panel 33 is detachably connected to the inclined pull strap 31 through the hook and loop fastener 37, as shown in FIG. 6.

In the above embodiment, the pool body 1 is annular and includes a flexible inner layer 13, a flexible outer layer 14, and a plurality of second hard panels 12; the flexible inner layer 13 is connected to the flexible outer layer 14 to form a plurality of second mounting chambers 15 which are horizontally spaced and distributed; a crease portion 11 is formed between two adjacent second mounting chambers 15; and the second hard panels 12 are arranged in the second mounting chambers 15. Thus, along the crease sections 11, the second hard panels 12 can be stacked to achieve the storage of the foldable pool of this embodiment. Furthermore, the second hard panels 12 can be used to provide a vertical pool body 1. The pool body can accommodate the water in the pool in conjunction with the pool bottom. A cross section of the pool body 1 can be circular, polygonal, or irregularly shaped.

Specifically, a top of the flexible inner layer 13 is welded to a top of the flexible outer layer 14; a bottom of the flexible inner layer 13 is welded to the bottom of the flexible outer layer 14; and two sides of the flexible outer layer 14 and two sides of the second mounting chambers 15 are both welded with the flexible inner layer 13 to form the cease portions 11. Two sides of the flexible inner layer 13 are overlapped and welded to the two sides of the flexible outer layer 14 to form one of the cease portions 11, so as to form the pool body with a stable structure. A width of each crease portion can be 3 mm to 15 mm. According to the size of the pool, the width of each crease section 11 can be customized to maintain the strength of connection between the top of the flexible inner layer 13 and the flexible outer layer 14. In this embodiment, the width of each crease portion is 5 mm to 6 mm.

In an embodiment, a cross section of the pool body 1 is octagon; three second hard panels 12 are arranged on a pair of opposite side walls of the pool body 1; and one second hard panel 12 is arranged on each of the other four side walls of the pool body 1. The number of the supporting structures 3 is eight; and one supporting structure 3 is provided at a position, corresponding to each second hard panel 12, on the side wall of the pool body 1 that is correspondingly provided with the three second hard panels 12. In addition, the other two second hard panels 12 correspond to the other pair of opposite side walls of the pool body 1, so that the supporting structures 3 can stably support the pool body 1.

In an embodiment, a top of the pool body 1 is connected with a top covered edge 4. One end of the top covered edge 4 is connected to the flexible inner layer 13; and the other end of the top covered edge 4 is connected to the flexible outer layer 14 after being bent. By use of the top covered edge 4, the top of the flexible outer layer 14 and the top of the flexible inner layer 13 of the pool body 1 can be wrapped to protect the top of the pool body 1, thus preventing a pet from scratching or biting the top of the pool body 1 when the pet swims in the foldable pool. A protective effect is achieved.

In an embodiment, to facilitate production and manufacturing and save the manufacturing process, the top covered edge 4 and the flexible inner layer 13 use the same piece of fabric. Specifically, one end of the top covered edge 4, the top of the flexible outer layer 14, and the flexible inner layer 13 are welded together to form a third indentation 16, so as to fix the top covered edge 4, the flexible outer layer 14, and the flexible inner layer 13 together. A width of the third indentation 16 is 3 mm to 15 mm. According to the size of the pool, the width of the third indentation 16 can be customized to maintain the strength of connection among the top covered edge 4, the flexible inner layer 13, and the top of the flexible outer layer 14. In this embodiment, the width of the third indentation 16 is 5 mm to 6 mm.

In one embodiment, the pool bottom includes a peripheral connecting sheet 5 and a middle sheet 2; the peripheral connecting sheet 5 is an annular ring; the middle sheet 2 is connected to the peripheral connecting sheet 5 and is located in the middle of the peripheral connecting sheet 5; and an outer side of the peripheral connecting sheet 5 is connected to a bottom of the pool body 1.

The middle sheet 2 is welded to the peripheral connecting sheet 5 to form a fourth indentation 20; and the fourth indentation 20 is located at an inner side of the foldable pool and along a vertical direction. A width of the middle sheet 2 and/or peripheral connecting sheet 5 located on the inner side of the foldable pool is greater than or equal to a distance between the pool body 1 and the middle sheet 2, or a width L1 of the fourth indentation 20 along the vertical direction is greater than or equal to the distance L2 between the pool body 1 and the middle sheet 2 along a horizontal direction. Namely, during use of the foldable pool, the first indentation 35 or the middle sheet 2 and/or peripheral connecting sheet located in the foldable pool may cover the peripheral connecting sheet 5 between the pool body 1 and the middle sheet 2. This can increase the thickness and strength between the pool body 1 and the middle sheet 2, protect a position between the pool body 1 and the middle sheet 2, and prevent a pet from scratching the position.

In an embodiment, materials of the flexible outer layer 14, the flexible inner layer 13, the top covered edge 4, the peripheral connecting sheet 5, the middle sheet 2, the limiting pull strap 32, and the inclined pull strap 31 can all be laminated fabrics or plastic. The limiting pull strap 32 and the inner inclined layer 312 use the same piece of laminated fabric or plastic.

In this embodiment, the flexible outer layer 14 uses a laminated fabric formed by gluing a mesh fabric with yarns heavier than 500D and a density greater than 6*6 pieces/inch, or the flexible outer layer 14 uses a fabric with peel strength greater than 25 N/inch. The top covered edge 4 and the middle sheet 2 may both use a laminated fabric formed by laminating a polyester or nylon fabric with a PVC film or 190T polyester pongee, or the top covered edge 4 and the middle sheet 2 may both use a laminated fabric formed by gluing a mesh fabric with yarns heavier than 500D and a density greater than 18*18 pieces/inch. In this way, the overall strength of the foldable pool can be improved, so that when water in the foldable pool reaches a height, deformation of the pool body 1 is effectively reduced.

There are a plurality of supporting structures 3 which are arranged around the side walls of the pool body 1.

In the above embodiment, peripheral sides of the flexible inner layer 13 and the flexible outer layer 14 can be connected by welding, and the crease portions 11 can be formed by welding the flexible inner layer 13 to the flexible outer layer 14. One end of the top covered edge 4 is welded to the top end of the flexible inner layer 13, and the other end can be welded to the top end of the flexible outer layer 14. The inner inclined layer 312 and the outer inclined layer 311 can be connected by welding. One end of the limiting pull strap 32 away from the inner inclined layer 312 can be connected to the flexible outer layer 14 by welding, and one end of the inner inclined layer 312 away from the limiting pull strap 32 can be connected to the flexible outer layer 14 by welding. An outer side of the peripheral connecting sheet 5 can be connected to the flexible inner layer 13 by welding, and an inner side of peripheral connecting sheet 5 can be connected to the middle sheet 2 by welding, so as to complete the manufacturing of the foldable pool of this embodiment, which is convenient for production.

In an embodiment, the flexible inner layer 13, the flexible outer layer 14, and the top covered edge 4 can use the same piece of fabric. In this way, the manufacturing process, the time, and the cost can be saved. Of course, in other embodiments, the flexible inner layer 13 and the top covered edge 4 may use the same piece of fabric, and the flexible outer layer 14 uses another piece of fabric. Or, the flexible inner layer 13, the flexible outer layer 14, and the top covered edge 4 all use different fabrics. A manufacturer can customize the type of the fabric according to a need.

It should be noted that all directional indications (such as up, down, left, right, front, back . . . ) in the embodiments of the present disclosure are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present disclosure are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present disclosure.

The above descriptions are only preferred embodiments of the present disclosure, and are not intended to limit the patent scope of the present disclosure. Any equivalent structural transformation made by using the content of the specification and the drawings of the present disclosure under the invention idea of the present disclosure, directly or indirectly applied to other related technical fields, shall all be included in the scope of patent protection of the present disclosure.

What is claimed is:

1. A foldable pool for pet bath or swim, comprising a foldable pool body and a pool bottom made of a flexible material, wherein a plurality of supporting structures are arranged on an outer side wall of the pool body; each supporting structure comprises a limiting pull strap, an inclined pull strap, and a first hard panel;

one end of the limiting pull strap is connected to one end of the inclined pull strap; the limiting pull strap and the inclined pull strap are both made of flexible materials; the other end of the limiting pull strap is connected to the pool bottom or a position of the pool body adjacent to the pool bottom; the other end of the inclined pull strap is located above the limiting pull strap and connected to the pool body; and the first hard panel is detachably arranged on the inclined pull strap, wherein a first mounting chamber with a first opening on one side is formed in the inclined pull strap, and the first hard panel is detachably inserted into the inclined pull strap from the first opening in a manner that during use of the foldable pool, the first hard panel is arranged in the first mounting chamber, and in a store state of the foldable pool, the first hard panel is removed from the first opening and the first mounting chamber is empty to store the foldable pool; and wherein the pool body is annular and comprises a flexible inner layer, a flexible outer layer, and a plurality of second hard panels; the flexible inner layer is connected to the flexible outer layer to form a plurality of second mounting chambers which are horizontally spaced and distributed; a crease portion is formed between two adjacent second mounting chambers; and the second hard panels are arranged in the second mounting chambers.

2. The foldable pool according to claim 1, wherein the inclined pull strap comprises an outer inclined layer and an inner inclined layer, and the first mounting chamber is formed by connecting the outer inclined layer to the inner inclined layer.

3. The foldable pool according to claim 2, wherein the limiting pull strap and the inner inclined layer use a same piece of laminated fabric.

4. The foldable pool according to claim 3, wherein a top of the outer inclined layer is fixed on the pool body, and a bottom of the outer inclined layer is fixed at a bottom of a side surface of the inner inclined layer away from the pool body; and a top end of the inner inclined layer is connected at a position of the outer inclined layer adjacent to the top.

5. The foldable pool according to claim 4, wherein a bottom edge, and a side edge of the inner inclined layer are all welded to the outer inclined layer to form a first indentation; a top edge of the outer inclined layer is welded to the pool body to form a second indentation; and the second indentation is located above the first indentation.

6. The foldable pool according to claim 5, wherein a width of the first indentation is 3 mm to 15 mm.

7. The foldable pool according to claim 1, wherein a top of the flexible inner layer is welded to a top of the flexible outer layer; a bottom of the flexible outer layer is welded to the bottom and top of the flexible inner layer; two sides of the flexible inner layer are overlapped and welded to two sides of the flexible outer layer; the flexible outer layer is welded to the flexible inner layer on two sides of the second mounting chambers to form crease portions.

8. The foldable pool according to claim 7, wherein a width of each crease portion is 3 mm to 15 mm.

9. The foldable pool according to claim 1, wherein a cross section of the pool body is octagon; three second hard panels are arranged on a pair of opposite side walls of the pool body; one second hard panel is arranged on each of the other four side walls of the pool body;

the number of the supporting structures is eight; one supporting structure is provided at a position, corresponding to each second hard panel, on the side wall of the pool body that is correspondingly provided with the three second hard panels; and the other two second hard panels correspond to the other pair of opposite side walls of the pool body.

10. The foldable pool according to claim 1, wherein a top of the pool body is connected with a top covered edge; one end of the top covered edge is connected to the flexible inner layer; and the other end of the top covered edge is connected to the flexible outer layer after being bent.

11. The foldable pool according to claim 10, wherein the top covered edge and the flexible inner layer use the same piece of fabric.

12. The foldable pool according to claim 11, wherein one end of the top covered edge, the top of the flexible outer layer, and the flexible inner layer are welded together to form a third indentation; and a width of the third indentation is 3 mm to 15 mm.

13. The foldable pool according to claim 1, wherein the pool bottom comprises a peripheral connecting sheet and a middle sheet; the peripheral connecting sheet is an annular ring; the middle sheet is connected to the peripheral connecting sheet by welding; the middle sheet is located in the middle of the peripheral connecting sheet; and an outer side of the peripheral connecting sheet is connected to a bottom of the pool body.

14. The foldable pool according to claim 13, wherein the middle sheet is welded to the peripheral connecting sheet to form a fourth indentation; and the fourth indentation is located at an inner side of the foldable pool and along a vertical direction;

a width of the fourth indentation along the vertical direction is greater than or equal to the distance between the pool body and the middle sheet along a horizontal direction.

15. The foldable pool according to claim 13, wherein materials of the flexible outer layer, the flexible inner layer, the top covered edge, the peripheral connecting sheet, the middle sheet, the limiting pull strap, and the inclined pull strap are all laminated fabrics.

16. The foldable pool according to claim 15, wherein a material of the flexible outer layer is a laminated fabric formed by gluing a mesh fabric with yarns heavier than 500D and a density greater than 6*6 pieces/inch, or the flexible outer layer is a fabric with peel strength greater than 25 N/inch;

materials of the top covered edge and the middle sheet are one of the following:

a laminated fabric formed by laminating a polyester or nylon fabric with a polyvinyl chloride (PVC) film; and a laminated fabric formed by gluing a mesh fabric with yarns heavier than 500D and a density greater than 18*18 pieces/inch.

17. The foldable pool according to claim 1, wherein a plurality of first magnetic suction members are arranged on the first hard panel; a second magnetic suction member is arranged at a position, corresponding to one of the first magnetic suction members, on the inclined pull strap; and when the first hard panel is assembled on an outer side or inner side of the inclined pull strap, the first magnetic suction members attracts the second magnetic suction members;

the first magnetic suction member is a magnet or a metal sheet attracted to the magnet, and the second magnetic suction member is a magnet; or, the second magnetic suction member is a metal sheet attracted to the magnet, and the first magnetic suction member is a magnet.

18. The foldable pool according to claim 1, wherein the first hard panel is fixed on an inner side or outer side of the inclined pull strap in a buckled, adhered, or tied manner.

19. A foldable pool for pet bath or swim, comprising a foldable pool body and a pool bottom made of a flexible material, wherein a plurality of supporting structures are arranged on an outer side wall of the pool body; each supporting structure comprises a limiting pull strap, an inclined pull strap, and a first hard panel;

one end of the limiting pull strap is connected to one end of the inclined pull strap; the limiting pull strap and the inclined pull strap are both made of flexible materials; the other end of the limiting pull strap is connected to the pool bottom or a position of the pool body adjacent to the pool bottom; the other end of the inclined pull strap is located above the limiting pull strap and connected to the pool body; and the first hard panel is detachably arranged on the inclined pull strap, wherein a first mounting chamber with a first opening on one side is formed in the inclined pull strap, and the first hard panel is detachably inserted into the inclined pull strap from the first opening in a manner that during use of the foldable pool, the first hard panel is arranged in the first mounting chamber, and in a store state of the foldable pool, the first hard panel is removed from the first opening and the first mounting chamber is empty; and wherein a plurality of first magnetic suction members are arranged on the first hard panel; a second magnetic suction member is arranged at a position, corresponding to one of the first magnetic suction members, on the inclined pull strap; and when the first hard panel is assembled in the inclined pull strap, the first magnetic suction members attracts the second magnetic suction members, when the first hard panel is removed from the inclined pull strap, the first magnetic suction members are detached from the second magnetic suction members.

* * * * *